US009816343B2

(12) United States Patent
Løkka et al.

(10) Patent No.: US 9,816,343 B2
(45) Date of Patent: Nov. 14, 2017

(54) SUBSEA CONNECTION

(71) Applicant: FMC Kongsberg Subsea AS, Kongsberg (NO)

(72) Inventors: Trond Løkka, Notodden (NO); Oddbjørn Aase, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 14/901,208

(22) PCT Filed: Jun. 18, 2014

(86) PCT No.: PCT/EP2014/062831
§ 371 (c)(1),
(2) Date: Dec. 28, 2015

(87) PCT Pub. No.: WO2014/206831
PCT Pub. Date: Dec. 31, 2014

(65) Prior Publication Data

US 2016/0153257 A1 Jun. 2, 2016

(30) Foreign Application Priority Data

Jun. 24, 2013 (NO) ..... 20130878

(51) Int. Cl.
*E21B 33/038* (2006.01)
*E21B 19/00* (2006.01)
*E21B 17/01* (2006.01)

(52) U.S. Cl.
CPC ..... *E21B 33/038* (2013.01); *E21B 17/01* (2013.01); *E21B 19/002* (2013.01)

(58) Field of Classification Search
CPC ..... E21B 17/01; E21B 19/002; E21B 33/038
See application file for complete search history.

(56) References Cited

U.S. PATENT DOCUMENTS 3,510,153 A * 5/1970 Newton ..... E21B 33/038 285/18
4,648,629 A * 3/1987 Baugh ..... E21B 33/038 285/26
5,417,459 A * 5/1995 Gray ..... F16L 37/002 285/119
5,975,210 A * 11/1999 Wilkins ..... E21B 33/038 166/341

(Continued)

FOREIGN PATENT DOCUMENTS

GB 2495785 A * 4/2013 ..... E21B 33/038
WO WO 2010/019290 A1 2/2010

*Primary Examiner* — James G Sayre

(57) ABSTRACT

A subsea connection includes an umbilical termination head having a termination head housing and at least one first connecting line, each of which has a first mating device; a subsea base unit having a base unit housing and at least one second connecting line, each of which has a second mating device that is connectable with a corresponding first mating device; and a locking device for locking the termination head to the subsea base unit. The second mating device is fixed to a stab plate and kept in a retracted position before connection of the termination head with the base unit, and the stab plate and the second mating device are arranged to move relative to the base unit housing during connection.

20 Claims, 10 Drawing Sheets

(56) References Cited

U.S. PATENT DOCUMENTS

| | | | | |
|---|---|---|---|---|
| 6,085,785 | A * | 7/2000 | Smith, III | E21B 33/038 137/614 |
| 2004/0127084 | A1 | 7/2004 | Glennie et al. | |
| 2006/0090898 | A1 | 5/2006 | Tyrrell et al. | |
| 2008/0202760 | A1* | 8/2008 | Cosgrove | E21B 33/038 166/341 |
| 2012/0168168 | A1* | 7/2012 | Cruden | E21B 43/013 166/338 |

* cited by examiner

SUBSEA CONNECTION

FIELD OF THE INVENTION

The present invention concerns the field of umbilical termination connectors.

BACKGROUND OF THE INVENTION

Umbilical termination connectors are used to couple the end, or termination, of an umbilical to various types of subsea equipment. Such equipment may be stationary equipment such as manifolds and x-mas trees, or more temporary equipment such as work over packages, lower riser packages, IWOCS (Intervention Work Over Control System), etc. Termination connectors often comprise two main parts, an umbilical termination head (UTH) which is connected to the umbilical, and a base (UTH-base) which is generally fixed to the subsea equipment to be connected to the umbilical. The termination head has terminations for the electric (and possible optic) and fluid lines in the umbilical, and the base has means for coupling to said lines in the UTH.

In the prior art, connecting the UTH to a base requires either the use of guidelines or manual installation by use of divers or ROV's. Further, the installation requires a high degree of accuracy to avoid damaging the line-connectors on the UTH or base. The present invention provides an umbilical termination connector which avoids at least some of the disadvantages of the prior art connectors.

SUMMARY OF THE INVENTION

The present invention provides an umbilical termination connector comprising an umbilical termination head (UTH), which is connectable to an umbilical, and a base (UTH-base). The termination head may be installed on the base without requiring a guideline or assistance from an ROV or diver. The base comprises terminals for connecting to the electrical, optical and/or fluid line connectors on the UTH.

The invention is further defined in the appended claims, and in the following:

In one aspect, the present invention provides a subsea connection comprising:

- an umbilical termination head comprising a housing and at least one connecting line, wherein each connecting line comprises a first mating means;
- a subsea base unit comprising a housing and at least one connecting line, wherein each connecting line comprises a second mating means arranged to be connected with the cooperating first mating means; and
- locking means for locking the termination head to the subsea base unit;

wherein the second mating means are fixed to a stab plate and kept in a retracted position before connection of the termination head and the base unit, and wherein the stab plate is arranged to move the second mating means towards the first mating means during connection.

During connection the stab plate is arranged to move the second mating means to an extended position. In the extended position the second mating means are connectable to the first mating means. During connection, the stab plate and the second mating means are arranged to move relative to the housing of the base unit.

The first and second mating means are preferably cooperating stab connectors of any suitable type. The first mating means are preferably female connectors, and the second mating means are preferably cooperating male connectors.

A stab plate may be any assembly suitable for accommodating at least one second mating means and moving said mating means towards the first mating means during connection.

In a further aspect of the connection according to the invention, the second mating means are operably connected to a piston, preferably a piston of a hydraulic cylinder, and the piston is operably connected to trigger means, such that said piston is able to move the second mating means towards the first mating means when the trigger means are released. Although the piston is preferably moved as part of a hydraulic cylinder, other means for moving the piston are contemplated, such as a pneumatic cylinder or an electric motor.

In a further aspect of the connection according to the invention, the second mating means are operably connected to the trigger means by the stab plate.

In yet a further aspect of the connection according to the invention, the piston is operably connected to the trigger means by the stab plate.

In yet a further aspect of the connection according to the invention, the trigger means are released by interaction with the termination head.

In yet a further aspect of the connection according to the invention, the piston is pre-tensioned to move the second mating means towards the first mating means. The piston is preferably pre-tensioned by a spring, but other means such as compressed fluid may also be used.

In yet a further aspect of the connection according to the invention, at least a part of the second mating means is retracted into the base unit prior to release of the trigger means. Preferably, the connecting end of the second mating means is situated below, or in line with, a protective plate. The protective plate is provided with holes/perforations for accommodating the second mating means.

In yet a further aspect of the connection according to the invention, the first mating means is protected by a flange extension at an interfacing end of the termination head housing.

In yet a further aspect of the connection according to the invention, the termination head comprises a funnel and the base comprises a guide post, and the funnel is connectable with the guide post such that the second mating means and the first mating means are aligned when the trigger means are released.

In yet a further aspect of the connection according to the invention the funnel comprises an internal guide and the guide post comprises an external knob or rib.

In yet a further aspect of the connection according to the invention, the trigger means comprises at least one trigger finger arranged on the circumference of the base housing, and said finger comprises a first end engageable with the termination head, a section connected to the base unit, and a trigger portion operably connected to the stab plate, such that the trigger portion releases said stab plate when the first end is fully engaged with the termination head. The section being connected to the base unit is preferably pivotably connected to the base unit. In a preferred aspect the trigger means or trigger fingers are biased towards a non-release position, i.e., a position wherein the trigger portion is operably connected to the stab plate such that said stab plate is prevented from moving towards the UTH.

In yet a further aspect of the connection according to the invention, the locking means comprises at least one locking finger arranged on the circumference of the base housing, and said finger comprises an end which is lockable with the termination head. One section of the locking finger is preferably pivotably connected to the base unit. In a preferred aspect the locking means or locking fingers are biased towards a locked position.

In yet a further aspect of the connection according to the invention, the locking finger is operably connected to the stab plate, such that the locking finger is kept in a secured locking position when the first mating means and the second mating means are connected. In a preferred aspect, the locking finger is operably connected to the stab plate via a securing roll which is in contact with a surface of said finger.

In a further aspect, the invention provides a method for connecting an umbilical to a subsea structure, comprising the steps of:

connecting an umbilical, having at least one transfer line, to an umbilical termination head comprising a housing and at least one connecting line, wherein each connecting line comprises a first mating means, such that the transfer line is in transferable contact with the first mating means;

guiding the termination head towards a base unit arranged on a subsea structure, wherein the base unit comprises a housing and at least one connecting line, wherein each connecting line comprises a second mating means which is arranged to be connected with the cooperating first mating means and is fixed in a stab plate and kept in a retracted position before connection of the termination head and the base unit, and wherein the stab plate is arranged to move the second mating means towards the first mating means during connection;

moving the termination head into contact with the base unit such that the second mating means are aligned with the first mating means; and moving the termination head into connection with the base unit such that the stab plate moves the second mating means to fully connect with the first mating means.

In yet a further aspect, the invention provides a connection comprising:

an umbilical termination head comprising a housing and at least one connecting line, wherein each connecting line comprises a first mating means;

a subsea base unit comprising a housing and at least one connecting line, wherein each connecting line comprises a second mating means arranged to be connected with the cooperating first mating means; and locking means for locking the termination head to the subsea base unit;

wherein the termination head comprises a funnel comprising an internal guide and the base comprises a guide post comprising an external knob or rib, and wherein the funnel is connectable with the guide post such that the second mating means and the first mating means are aligned before being connected. The knob or rib and the internal guide are shaped in a manner such that the interaction guides the funnel and the guide post into correct positioning, i.e., a position wherein the first and second mating means are aligned. The knob or rib and the internal guide are cooperatively configured.

In yet a further aspect of the connection according to the invention, the first mating means is arranged around the circumference of the funnel and the second mating means is arranged around the guide post.

BRIEF DESCRIPTION OF THE DRAWINGS

The present invention will be further explained by use of the specific embodiment shown in the drawings, wherein.

DETAILED DESCRIPTION OF THE INVENTION

An umbilical connector assembly according to the present invention comprises an umbilical termination head (UTH) and a complementary base (UTH-base) for coupling to said head. The UTH is connected to one end of an umbilical, while the base may be mounted on any equipment which is to be connected to the umbilical via the UTH. A specific embodiment of such an assembly is described in detail in the following.

Figure 1A:
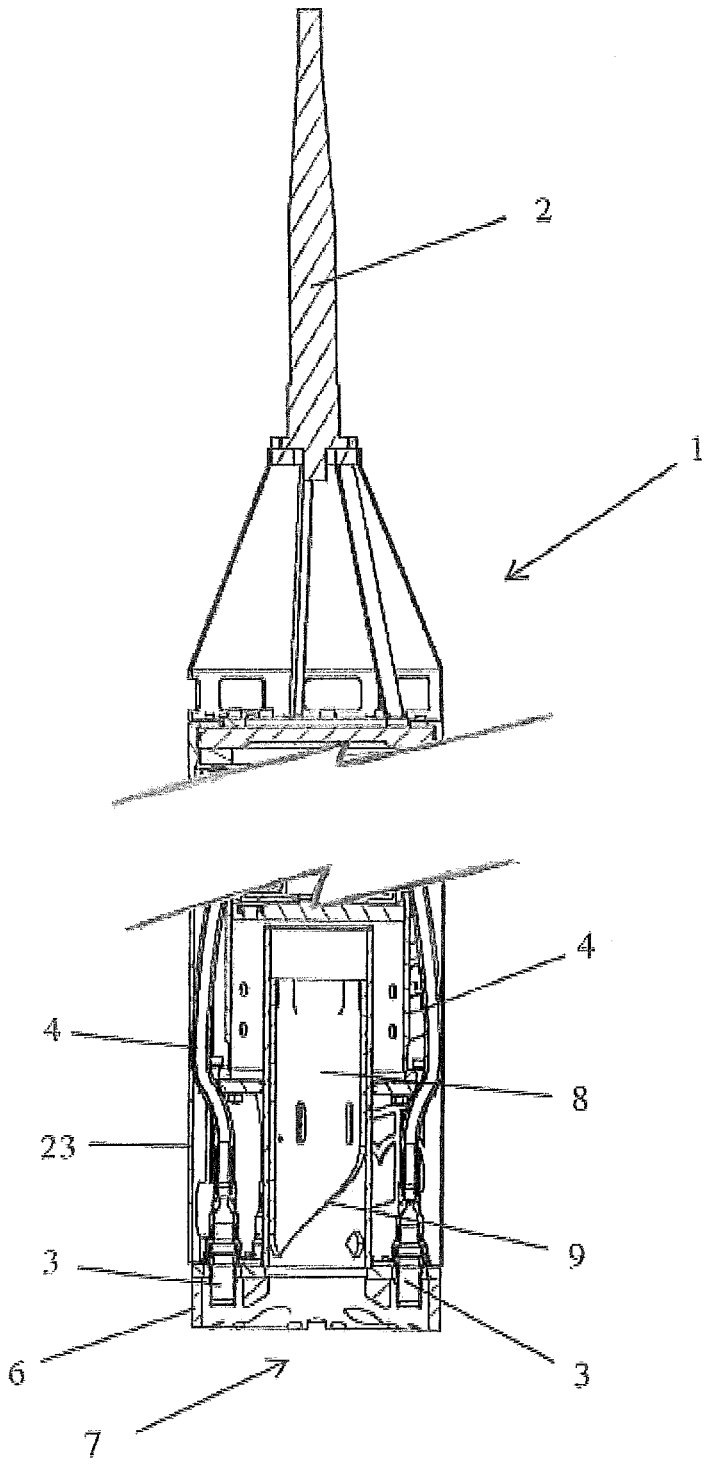
FIG. 1*a* shows a cross-section of an umbilical termination head (UTH) in accordance with the present invention.

A detailed embodiment of a UTH 1 is shown in FIG. 1*a*, wherein at least one umbilical 2 is terminated at one end of the UTH. The umbilical(s) 2 may provide various signal, power or fluid lines (collectively referred to as transfer lines), such as electrical or fiber optical lines, hydraulic fluid lines, etc., which are in transferable contact with the external head connectors 3 of the UTH via the connecting lines 4. A connecting line 4 may be any suitable communication or power line. The head connectors 3 are situated at the end of the UTH 1 for interfacing with the UTH-base 5, shown in FIG. 2. The connectors 3 are shielded from external damage by a circumferential part 6 of the UTH housing 23 that extends past the connectors 3 in the longitudinal direction of the UTH. At its interfacing end 7, the UTH has a guiding funnel 8 having an inner surface with a partially helical guide 9. At the circumference, close to the interfacing end 7, the UTH has shear pins 10 which the locking fingers 11 on the base 5 may engage (see FIG. 3).

Figure 1B:
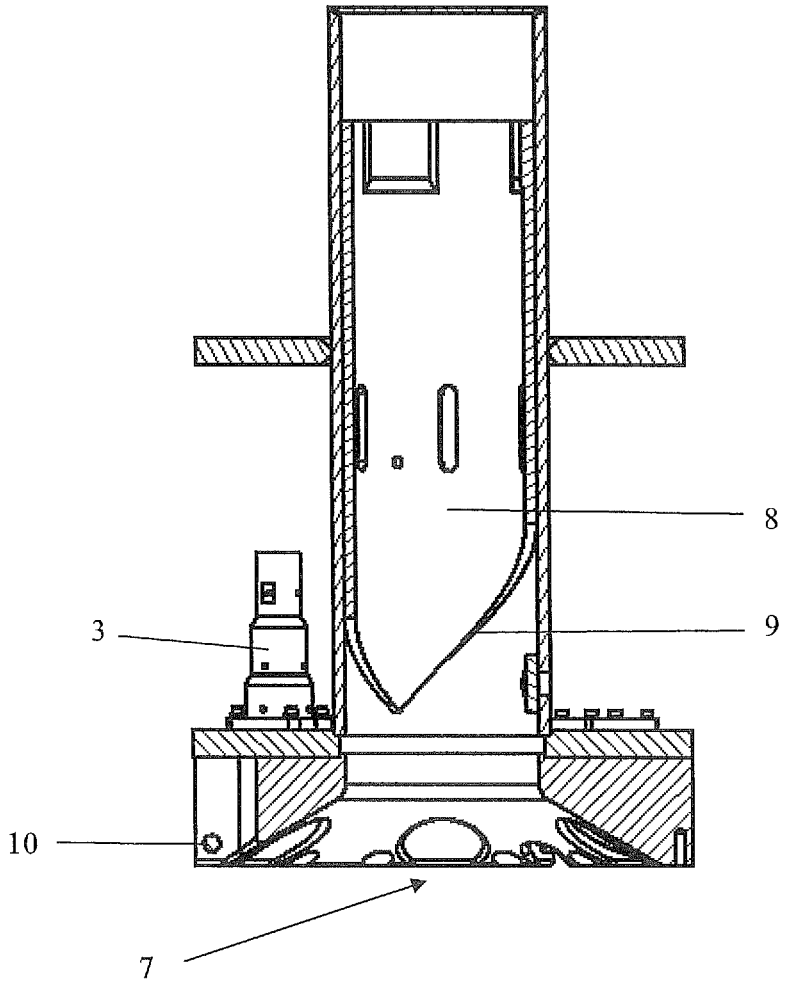
FIG. 1*b* shows a simplified cross-section of the UTH in FIG. 1*a*.

A simplified drawing of the UTH 1 is shown in FIG. 1*b* and used in the subsequent figures to describe the embodiment in more detail.

Figure 2:
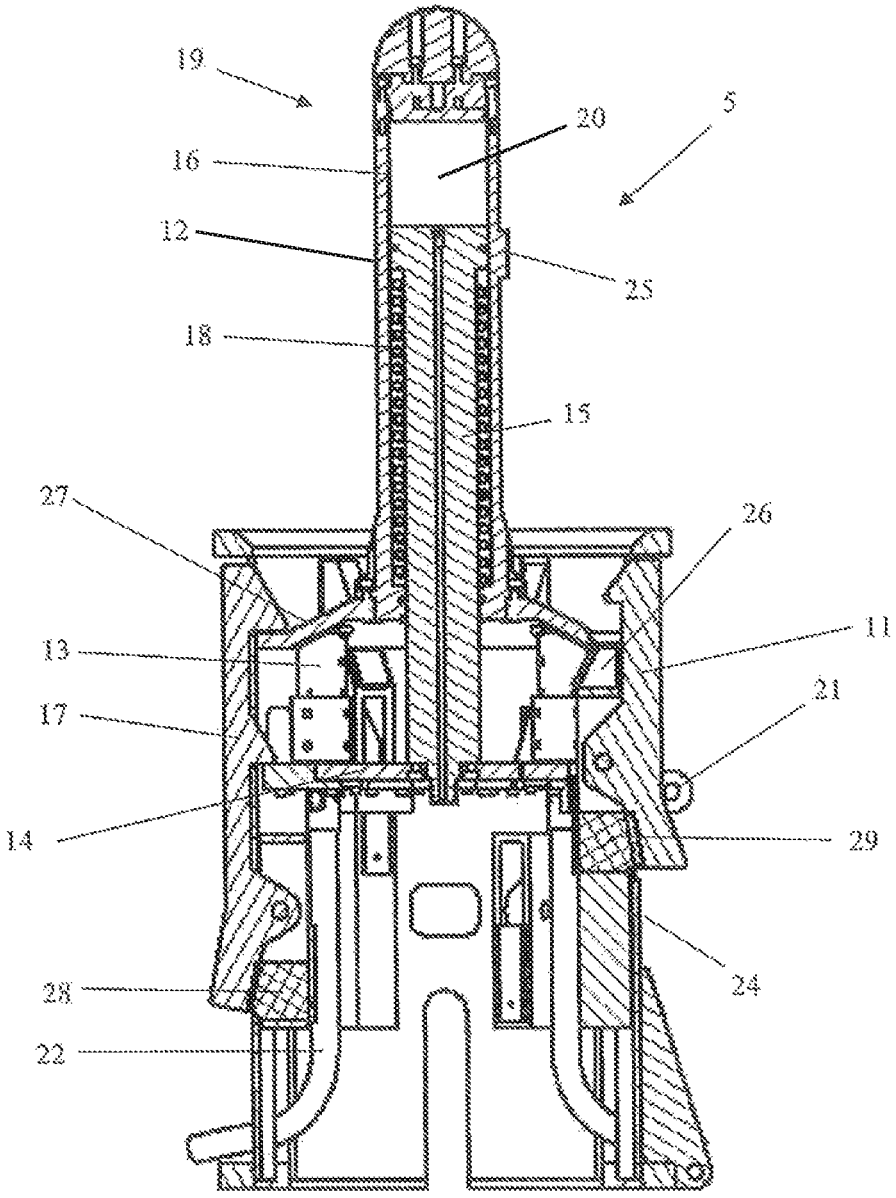
FIG. 2 shows a cross-section of a UTH-base in accordance with the present invention.
Figure 3:
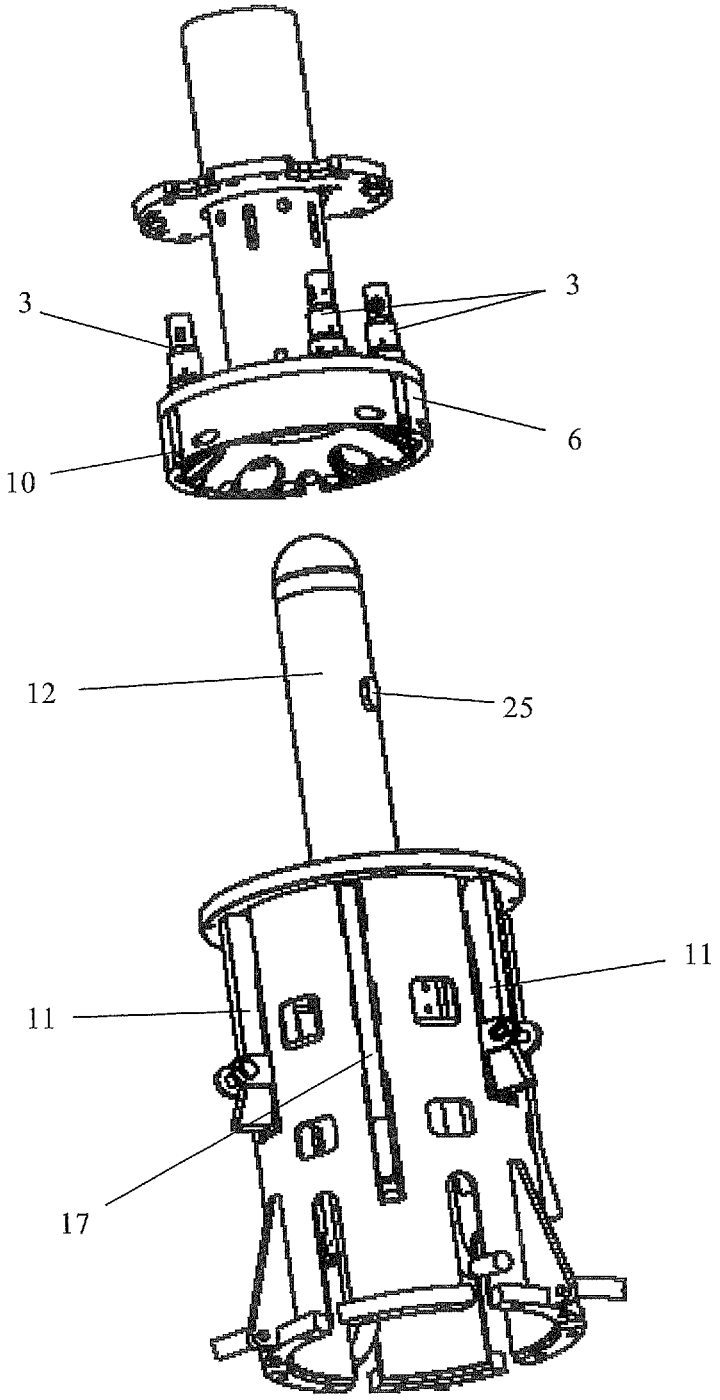
FIG. 3 shows a perspective view of a UTH-base and UTH just prior to initial mating.

The complementary UTH-base 5 shown in FIG. 2 has a housing 24 and a guide post 12 at an end 19 of the UTH-base for interfacing with the UTH. The guide post 12 features an external knob or rib 25 suitable for cooperating with the helical guide 9 of the funnel 8 in the UTH. The UTH-base 5 features base connectors 13 at the same end as the guide post 12 for connecting with the head connectors 3. The base connectors 13 are operably engaged with a stab plate 14 and kept in a retracted position, relative to the interfacing end 19 of the base, prior to mating with the head connectors. In the retracted position, the connecting end of the base connectors 13 are situated below, or in line with, a protective plate 27 which prevents the connectors from being damaged during initial mating with the UTH. The protective plate has holes through which the base connectors are pushed during connection. The base connectors are arranged at one end of the connecting lines 22, and said lines may further be connected to any desired subsea equipment to provide required signals/power/fluid. The stab plate 14 is connected to a piston 15 of a hydraulic cylinder 16 arranged inside the guide post 12 and is held in a fixed position by trigger fingers 17. The trigger fingers are biased to hold the stab plate 14 in the fixed position by interaction with a rubber element 28. The piston 15 is pre-tensioned by a spring 18 to move the stab plate 14, and consequently the base connectors 13, in the direction of the interfacing end 7 of the UTH. The stab plate 14 is in a middle position operably connected to the trigger fingers 17, which prevent the stab plate from moving towards the interfacing end 19 of the base when they are engaged. The trigger fingers 17 are evenly distributed at the circumference of the base as shown in FIG. 3. The base also comprises locking fingers 11 for engaging with the shear pins 10 on the UTH. The locking fingers 11 are evenly distributed at the circumference of the base, as shown in FIG. 3. The UTH-base 5 may be connected to subsea equipment (not shown) via conventional means.

Figure 4:
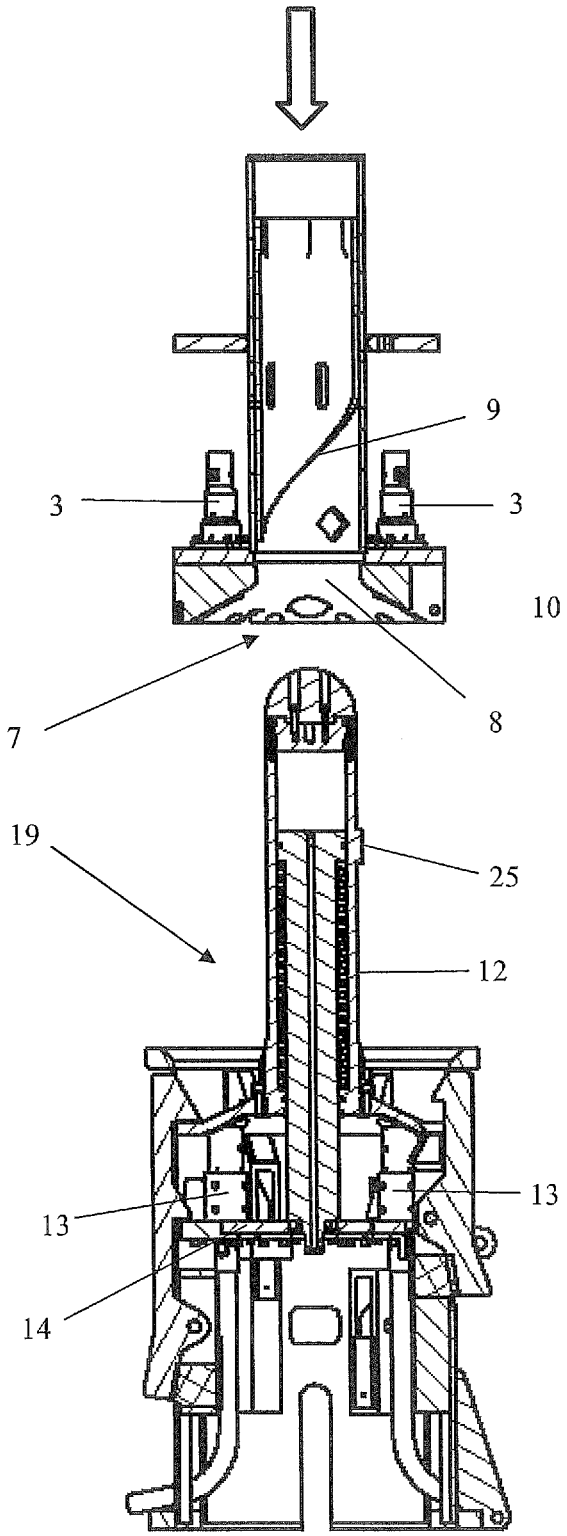
FIG. 4 shows a cross-section of a UTH-base and UTH just prior to initial mating.
Figure 5:
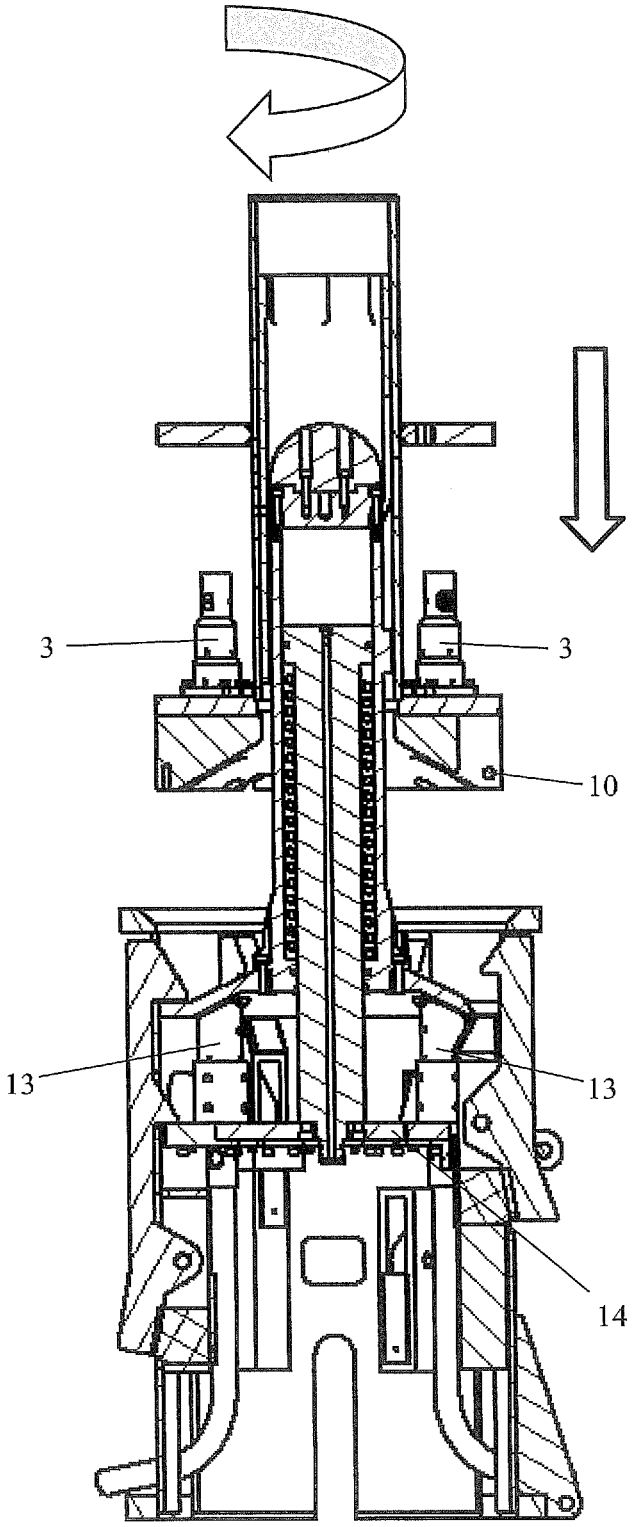
FIG. 5 shows a cross-section of a UTH-base and UTH during their alignment and initial mating.
Figure 6:
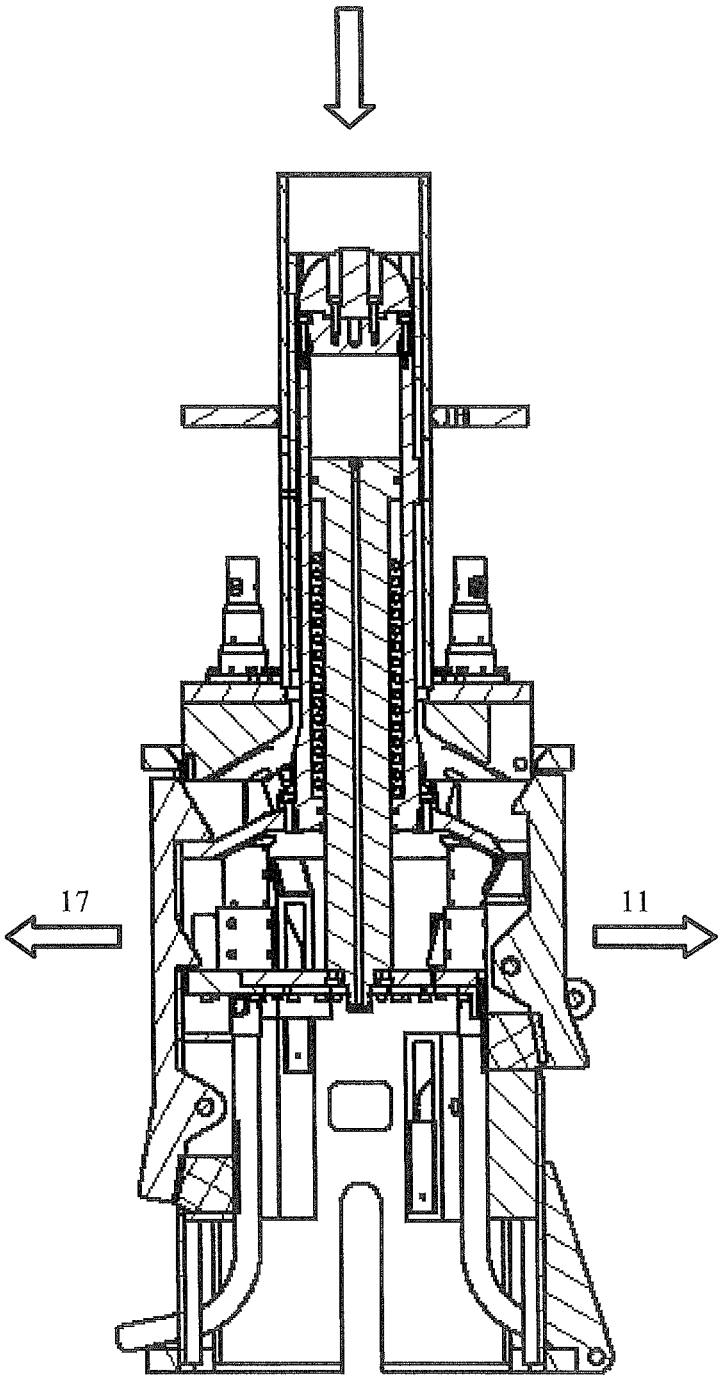
FIG. 6 shows a cross-section of a UTH-base and UTH during landing of the UTH after alignment.
Figure 7:
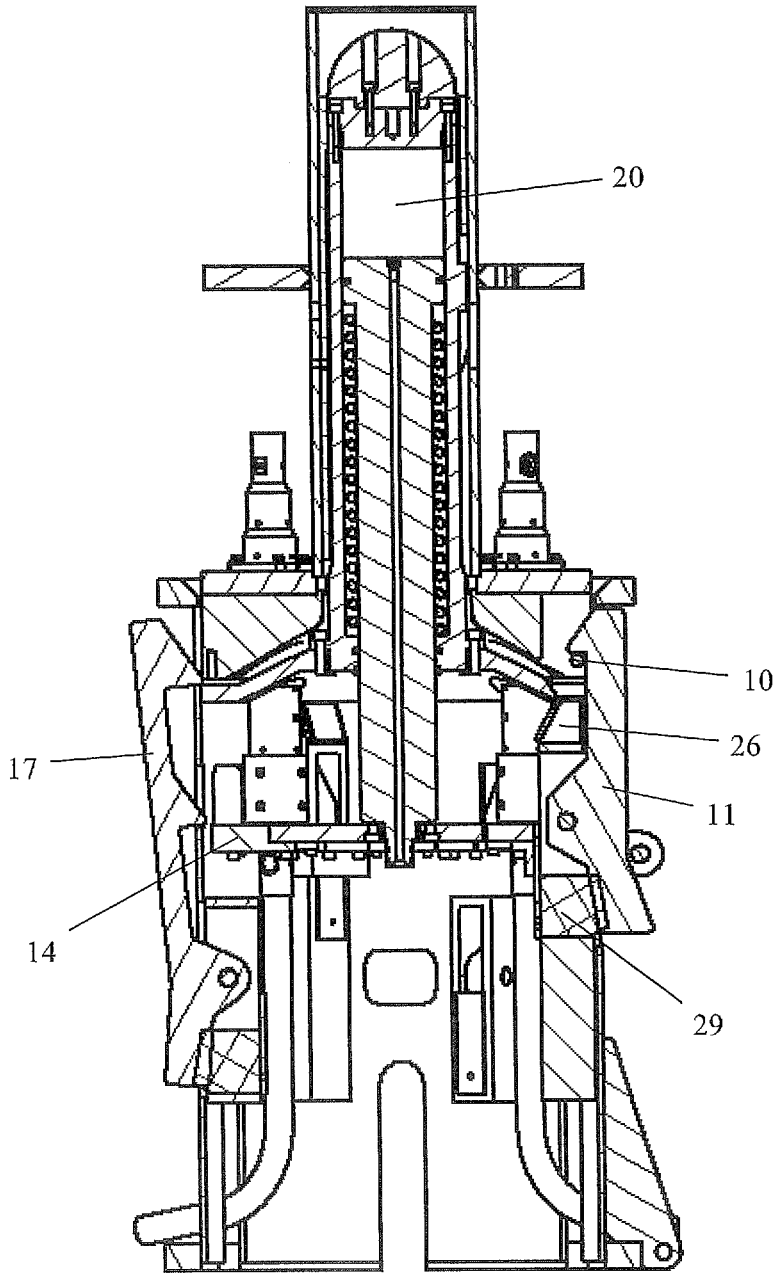
FIG. 7 shows a cross-section of a UTH-base and UTH after fully landing the UTH.
Figure 8:
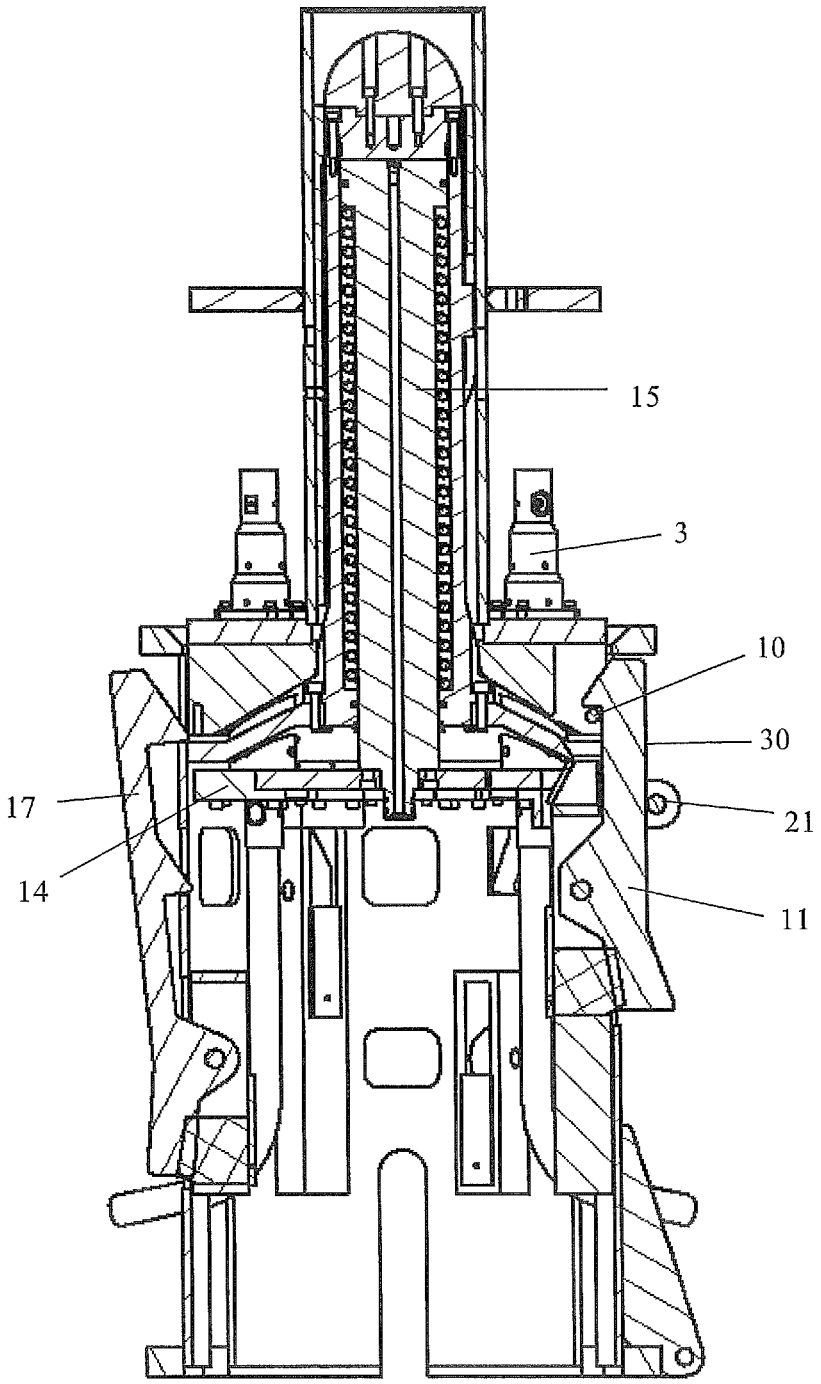
FIG. 8 shows a cross-section of a UTH-base and UTH after complete mating of the connectors.

In use, an umbilical 2 is first terminated at the UTH 1. The UTH is then brought into position having its interface end 7 facing the interface end 19 of the base (see FIGS. 3 and 4). The UTH is lowered/moved towards the UTH-base 5 such that the guide post 12 enters the funnel 8. The partly helical guide 9 of the funnel interacts with the knob/rib 25 on the guide post 12, causing the UTH to rotate into the proper mating position, that is, a position in which the head connectors 3 (i.e., the connectors of the UTH) and the base connectors 13 (i.e., the connectors of the UTH-base) are aligned opposite each other (see FIG. 5). After alignment, and during landing of the UTH 1 onto the UTH-base 5, the UTH pushes the locking fingers 11 and the trigger fingers 17 of the UTH-base in a direction away from the axial center of the base (see FIG. 6). When the UTH is fully landed, the locking fingers 11 are latched onto the shear pins 10, thereby locking the UTH and the UTH-base together (see FIG. 7). The locking fingers are biased towards the latched position, i.e., locked onto the shear pins, by rubber elements 29. When the UTH is fully landed, the trigger fingers 17 are also released and no longer engaged with the stab plate 14. When the hydraulic fluid 20 is allowed to exit the hydraulic cylinder, the piston 15 will move the stab plate 14, and thus the base connectors 13, towards the head connectors 3 to provide a complete mating of the corresponding base and head connectors (see FIG. 8). Preferably, hydraulic fluid 20 is freely allowed to exit the hydraulic cylinder, and the piston 15 will move the stab plate 14, and the base connectors, towards the head connectors as soon as the trigger fingers 17 are disengaged from the stab plate 14. Optionally, the stab plate will not move until the hydraulic fluid is allowed to exit the hydraulic cylinder, for instance, by remotely operating a valve. The stab plate 14 is further operably connected to securing rolls 21, which secure the locking fingers 11 in a locking position by preventing the locking fingers 11 from being moved in a direction away from the UTH when the umbilical termination connector is fully mated. The rolls 21 are arranged to move along a surface 30 of the locking fingers, and said surface is designed such that the locking fingers are held in a secured locked, locked/neutral or secured unlocked/open position, depending on the position of the rolls along said surface. The locking fingers 11 and the cooperating shear pins 10 provide a weak link, wherein the pins are dimensioned to break when the umbilical is subjected to a tension force exceeding a preset limit. In such a case, the UTH 1 is brought topside and the broken shear pins 10 replaced. The UTH-base is provided with recesses 26 situated below each site of interaction between the shear pins and locking fingers. The recesses are able to accommodate the broken shear pins and thus prevent the shear pins from fouling up subsequent operation of the UTH-base by, for instance, getting lodged in between a locking finger and the base housing. Before reconnecting the UTH 1 with the UTH-base 5, the UTH-base is reset by applying hydraulic pressure to the piston, which then moves the stab plate 14 into a middle position. In the middle position the locking fingers 11 are no longer secured by the securing rolls 21 and the trigger fingers 17 are reengaged with the stab plate 14.

Figure 9:
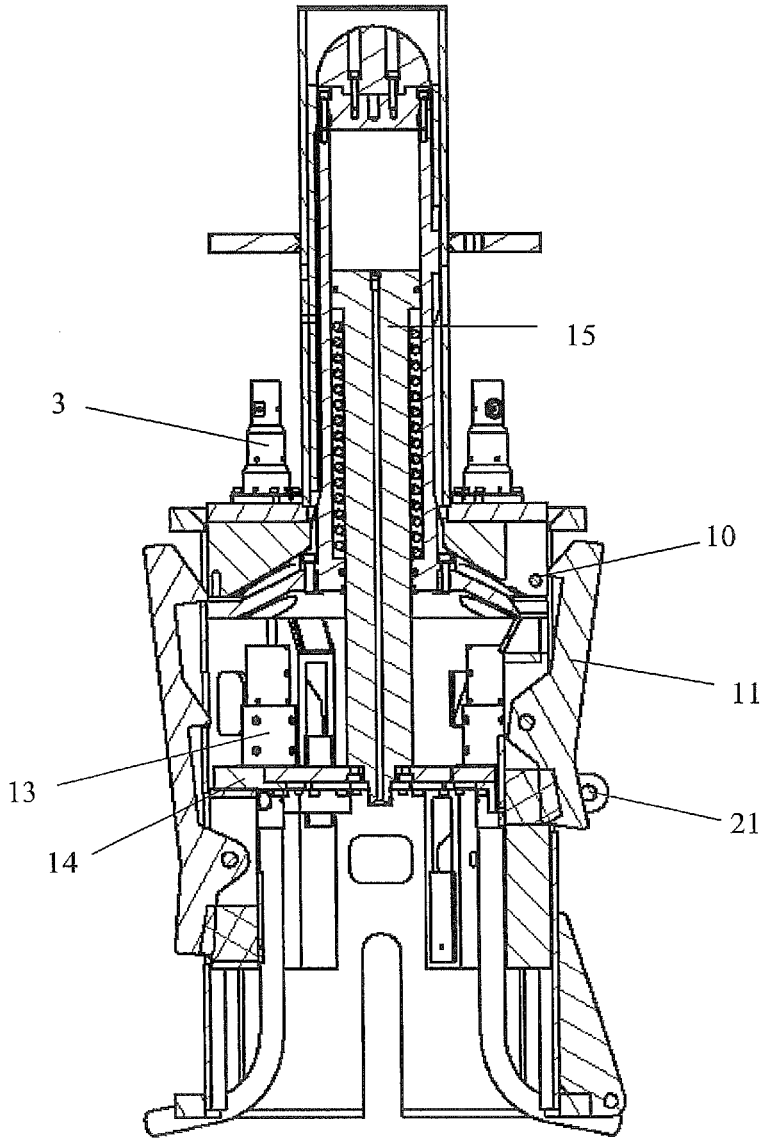
FIG. 9 shows a cross-section of a UTH-base and UTH fully unlocked and ready to be disconnected.

To intentionally disconnect the UTH from the UTH-base, hydraulic fluid 20 pressure is increased and the piston 15 will move the stab plate 14, and the base connectors 13, in an axial direction away from the head connectors 3 (see FIG. 9). When the stab plate 14 is moved from the middle position to a distal position with regard to the UTH, the securing rolls 21 cause the locking fingers to disengage from the shear pins 10. The securing rolls 21 keep the locking fingers 11 in a disengaged position when the stab plate is in the distal position, and the UTH may consequently be separated from the UTH-base.

The invention claimed is:

1. A subsea connection comprising:

an umbilical termination head comprising a termination head housing and at least one first connecting line, each first connecting line comprising a first mating means;

a subsea base unit comprising a base unit housing and at least one second connecting line, each second connecting line comprising a second mating means arranged to be connected with a corresponding first mating means; and locking means for locking the termination head to the subsea base unit, wherein the second mating means is fixed to a stab plate and kept in a retracted position before connection of the termination head to the base unit, the stab plate being arranged to move the second mating means towards the first mating means during connection, and the stab plate and the second mating means being arranged to move relative to the base unit housing during connection.

2. A connection according to claim 1, wherein the stab plate is arranged to move the second mating means into an extended position during connection to thereby connect the second mating means to the first mating means.

3. A connection according to claim 1, wherein the second mating means is operably connected to a piston which in turn is operably connected to a trigger means, such that the piston is able to move the second mating means towards the first mating means when the trigger means is released.

4. A connection according to claim 3, wherein the second mating means is operably connected to the trigger means by the stab plate.

5. A connection according to claim 4, wherein the piston is operably connected to the trigger means by the stab plate.

6. A connection according to claim 3, wherein the trigger means are released by interaction with the termination head.

7. A connection according to claim 3, wherein the piston is pre-tensioned to move the second mating means towards the first mating means.

8. A connection according to claim 3, wherein at least a part of the second mating means is retracted into the base unit prior to release of the trigger means.

9. A connection according to claim 3, wherein the termination head comprises a funnel, the base comprises a guide post, and the funnel is connectable with the guide post such that the second mating means and the first mating means are aligned when the trigger means is released.

10. A connection according to claim 9, wherein the funnel comprises an internal guide, and the guide post comprises an external knob or rib which is configured to engage the internal guide.

11. A connection according to claim 3, wherein the trigger means comprises at least one trigger finger arranged at a circumference of the base unit housing, said finger comprising a first end which is engageable with the termination head, a section which is connected to the base unit, and a trigger portion which is operably connected to the stab plate, such that the trigger portion releases said stab plate when the first end is fully engaged with the termination head.

12. A connection according to claim 1, wherein the first mating means is protected by a flange extension located on an interfacing end of the termination head housing.

13. A connection according to claim 1, wherein the locking means comprises at least one locking finger arranged at a circumference of the base unit housing, said finger comprising an end which is lockable with the termination head and a section which is connected to the base unit.

14. A connection according to claim 13; wherein the locking finger is operably connected to the stab plate such that the locking finger is kept in a secured locking position when the first mating means and the second mating means are connected.

15. A method for connecting an umbilical to a subsea structure, comprising the steps of:

connecting an umbilical having at least one transfer line to an umbilical termination head comprising a termination head housing and at least one connecting line, each connecting line comprising a first mating means, and being configured such that the transfer line is in transferable contact with the first mating means;

guiding the termination head towards a base unit arranged on a subsea structure, the base unit comprising a base unit housing and at least one connecting line, each connecting line comprising a second mating means, arranged to be connected with a corresponding first mating means, the second mating means being fixed in a stab plate and kept in a retracted position before connection of the termination head to the base unit, the stab plate being arranged to move the second mating means towards the first mating means during connection, and the stab plate and the second mating means being arranged to move relative to the base unit housing during connection;

moving the termination head into contact with the base unit such that the second mating means is aligned with the first mating means; and moving the termination head into connection with the base unit such that the stab plate can move the second mating means to fully connect with the first mating means.

16. A subsea connection for connecting at least one umbilical line with a corresponding subsea equipment line, the subsea connection comprising:

an umbilical termination head which includes:

a termination head housing having a first end; and a first connector which is connected to a corresponding first connecting line, the first connecting line being connectable to the umbilical line;

a subsea base unit which is connectable to the termination head and which includes:

a base unit housing having a second end which is configured to engage the first end when the termination head is connected to the base unit; and a second connector which is releasably connectable to the first connector and is connected to a corresponding second connecting line, the second connecting line being connectable to the subsea equipment line;

a stab plate on which the second connector is mounted, the stab plate being axially movable relative to the base unit housing from a first position in which the second connector is recessed within the second end and a second position in which the second connector is connectable to the first connector;

means for moving the stab plate from the first position to the second position; and at least one trigger finger which is pivotally connected to the base unit housing and is configured such that, in a latched position the trigger finger engages the stab plate to thereby retain the stab plate in the first position, and in an unlatched position the trigger finger releases the stab plate to thereby allow the stab plate to move to the second position;

wherein upon connection of the termination head to the base unit, the first end moves the trigger finger from the latched position to the unlatched position to thereby allow the moving means to move the stab plate from the first position to the second position and connect the first connector to the second connector.

17. The subsea connection according to claim 16, further comprising at least one locking finger which is pivotally connected to the base unit housing and is configured to engage a corresponding locking member on the termination head to thereby secure the termination head to the base unit when the termination head is connected to the base unit.

18. The subsea connection according to claim 17, wherein the locking member comprises a shear pin which is connected to the termination head housing.

19. The subsea connection according to claim 16, wherein the moving means comprises a piston which is connected to the stab plate and a spring which is operably engaged between the piston and the base unit housing to thereby bias the stab plate toward the second position.

20. The subsea connection according to claim 19, further comprising:

at least one locking finger which is pivotally connected to the base unit housing and is configured to engage a corresponding locking member on the termination head to thereby secure the termination head to the base unit when the termination head is connected to the base unit; and wherein the piston forms part of a hydraulic cylinder which is configured to selectively move the stab plate from the first position to a third position in which the stab plate or a member connected to the stab plate pivots the locking finger away from the locking member to thereby unlock the termination head from the base unit.

* * * * *